US007557704B2

(12) United States Patent
DeBaugh

(10) Patent No.: US 7,557,704 B2
(45) Date of Patent: Jul. 7, 2009

(54) EMERGENCY LOCATION IDENTIFICATION SYSTEM

(76) Inventor: Clifton DeBaugh, 363 S. Lower Sacramento Rd., # 144, Lodi, CA (US) 95242

( * ) Notice: Subject to any disclaimer, the term of this patent is extended or adjusted under 35 U.S.C. 154(b) by 286 days.

(21) Appl. No.: 11/625,073

(22) Filed: Jan. 19, 2007

(65) Prior Publication Data

US 2008/0175355 A1 Jul. 24, 2008

(51) Int. Cl.
*G08B 1/08* (2006.01)

(52) U.S. Cl. ..... 340/539.16; 340/506; 340/511; 340/539.1; 340/286.05; 340/286.06; 340/332; 340/815.4; 362/276; 379/37; 379/45

(58) Field of Classification Search ..... 340/539.16, 340/539.1, 506, 511, 539.22, 539.26, 286.02, 340/286.05, 286.06, 332, 540, 815.4, 321, 340/693.9, 693.11; 379/37, 45; 362/276
See application file for complete search history.

(56) References Cited

U.S. PATENT DOCUMENTS 5,960,061 A * 9/1999 Fahie et al. ..... 379/37
6,114,948 A * 9/2000 Astell ..... 340/332
6,205,203 B1 * 3/2001 Gorman et al. ..... 379/37
6,304,174 B1 * 10/2001 Smith et al. ..... 340/471
6,307,920 B1 * 10/2001 Thomson et al. ..... 379/45
7,012,544 B2 * 3/2006 Cunningham et al. .. 340/815.55
7,436,294 B2 * 10/2008 Saga et al. ..... 340/506

* cited by examiner

*Primary Examiner*—Davetta W Goins
(74) *Attorney, Agent, or Firm*—IPLA P.A.; James E. Bame

(57) ABSTRACT

An emergency location identification system is provided. The system includes a monitoring unit and an emergency light unit. The monitoring unit is connected to a telephone system of a facility, and responds to some predetermined dialing of the telephone generating signals, which is going to control the behavior of the emergency light unit. The emergency light unit includes a plurality of colors and shapes adapted to display a emergency location identification to an emergency crew or visitors. The emergency light unit may include blue, green, and red lights and may flash for some instances. Also, the emergency light may have a predetermined shape such as arrow, triangle, and others to alert people properly for the emergency situations.

19 Claims, 9 Drawing Sheets

EMERGENCY LOCATION IDENTIFICATION SYSTEM

BACKGROUND OF THE INVENTION

The present invention relates to an emergency alert device and, more particularly, to an improved emergency alert system enabling emergency location identification in a quick, convenient and efficient manner.

An emergency takes place without regard to precautions. Everyone living on the earth is exposed to emergency situations like thefts, fires, injury accidents, natural disasters etc. Urgent medical attention is critical on the scene of emergency to cope with such incidents so that a number of precautionary measures have been introduced. Alarm systems for earthquake, hurricane and flood have been around for years. Fire alarm system is one of the old skills we developed and still use. Still, residential crimes increase to an extent that a substantial number of households end up renting a household emergency alert system.

The most known emergency system includes a 911 service. An emergency is reported through a centralized communication network, and then team of crews for fighting emergency is dispatched to the scene of the emergency. In many cases, however, it is challenging, especially in a metropolitan area, for the emergency crew to locate the scene where the victims of the emergency need desperate help. The street clogs down by cars in the first place. Even though the emergency crews got close to the scene, now it is hard to find the exact location of the emergency site. The great feat of the modern macro-engineering, the city, is entwined with streets and roads, speckled with houses and buildings everywhere. With all these myriads of obstacles, pinpointing the right location of emergency is not easy no matter how imminent the situations are.

Therefore, there has been a need for an emergency location identification system for a long time considering the importance of the emergency service and the time-sensitiveness of the emergency service.

SUMMARY OF THE INVENTION

The present invention contrives to solve the needs and problems in the emergency service.

An objective of the invention is to provide an emergency location identification system that guides the emergency crews visually in the myriad of houses and buildings.

Another objective of the invention is to provide a location identification system that marks a location for visitors.

Still another objective of the invention is to provide a location identification system that displays predetermined visual information for visitors.

Still another objective of the invention is to provide a visual marker for emergency crews entering the home, which lights at the bedroom doors adding to increased safety for responding crews.

To achieve these and other objectives, an emergency location identification system with a monitoring unit and an emergency light unit is provided. The emergency location identification system associated with a telephone system comprises the monitoring unit and the emergency light unit. The monitoring unit is configured to be connected to the telephone system for generating signals by monitoring phone calls made at the telephone system. The emergency light unit is controlled by the signals from the monitoring unit. The emergency light unit comprises one or more first light panels and a plurality of second light panels, and the light panels are disposed at a plurality of locations around a facility in which the telephone system is located.

The emergency light unit is activated when an emergency call is made at the telephone system, and the emergency light unit displays a visual identification and direction of the location associated with the telephone system. The emergency call may comprise a 911 call. The telephone system comprises a plurality of phone jacks, and the monitoring unit is adapted to be plugged into one of the phone jack. The telephone system may comprise a main phone junction box, and the monitoring unit is adapted to be connected to the main phone junction box.

The monitoring unit is configured to be plugged into an external power supply. The external power supply comprises a wall outlet. The monitoring unit may comprise a power backup. The power backup comprises one or more batteries. The monitoring unit is configured to be plugged into a cigarette lighter/computer plug in a vehicle. The first light panel may be lit steadily upon receiving a first signal from the monitoring unit, and the second light panel flashes with a predetermined interval upon receiving a second signal from the monitoring unit. The second signal may be issued by the emergency call.

The first light panel may comprise a plurality of green lights. The second light panel may comprise a plurality of flashing blue lights. The system may further comprise a manual controller for controlling the emergency location identification system manually. The system may further comprise a timer for controlling the time of operation of the light panels, and the timer sets the time of operation of the light panels.

The system may further comprise a flash sequencer for controlling light flashing patterns of the second light panels. At least part of the first and second light panels are disposed around the facility. The first and second light panels are disposed to indicate a direction to the facility. The facility may comprise a house, an apartment complex comprising a plurality of subdivisions that look alike, and a building comprising a plurality of rooms that look alike. At least part of the first and second light panels may be disposed at driveways or corners of neighboring buildings. The first and second light panels may be disposed next to an address panel of the facility.

The emergency light unit may further comprise one or more light casing. The light casing contains at least part of the lights. At least part of the light panels may have arrow shapes. The light panels having the arrow shape flash in a coordinated pattern simulating a flying arrow upon receiving a signal from the monitoring unit, and the signal is issued by the emergency call.

In other embodiment of the invention, the emergency location identification device is equipped with an external blue and green LED light panel. The notification light is mounted on an exterior wall above the house address numbers, that is activated whenever 911 is dialed. The purpose of the Blue Light is to reduce 911 emergency response times by allowing quick and accurate visual location identification by emergency response teams whether within a subdivision or out in the countryside.

The monitoring device is designed to be mounted close to the main phone junction box and plugged into the main electrical supply. The monitoring unit has a battery backup in case of power outages. The light casing is designed as a snub-nosed triangle with two blue panels facing outward at 45 degree angles to the street with a green panel that faces the street located between the blue light panels. The blue light panels allow the "flashing blue" to be seen as emergency crews approach the home. The flashing blue lights can be seen in almost all adverse weather conditions. Emergency response teams will be able to quickly find the location of the emergency even in a subdivision where all the homes look alike.

For homes out in the countryside where mailbox numbers and addresses are very difficult to find, the Blue Light provides easy-to-find location lighting in an emergency situation when time really counts. For extended driveways, there will be a Blue Light at the driveway/street intersection with extra lights running along the driveway to direct response teams to the home experiencing the emergency.

As an added feature, the "green light panel" can be activated separately by the homeowner for use as a "welcome light" to let invited visitors know they have found the right house. The Blue Light is also equipped with a timer, so no matter which application, emergency or friendly, it will automatically go off at a preset amount of time, for example, 2 hours.

Apartment applications are very similar to the home installation with the monitoring device mounted at the main phone control panel for each building and Blue Lights mounted above each apartment door.

Industrial applications are numerous and as varied as the size of the complex. Lights can be mounted along driveways, on building corners, and over doorways. The monitoring device is mounted in the main phone panel control room and will be able to monitor one or multiple phone lines to light the appropriate door for emergency response personnel.

All lights may be white. Colors may be provided by a clip on lens cover. The lens cover is clear on top for easier location from the air.

Blue light flashes when 911 is dialed. Blue lights are on right and left sides, which may contain two rows of four lights each, total of 16 lights.

Green light may flash when the user dials preset code for light to activate enabling location to be found easier. Green lights is located on front of light, two rows of three lights each, total 6 lights The system may further comprise a controller. The controller's functions includes:

1. Connects to existing alarm monitoring equipment
2. Monitors phone line(s) for any 911 calls. If any number (s) preceding or after 911 other than repeat 911 light does not go on.
3. Able to power multiple lights ex: light on house, lights at bedroom doors and end of driveway.
4. Flash sequencer for light pattern flashing.
5. Light goes out after predetermined amount of time. (suggested 2-3 hours)
6. Plugs into existing phone jack allowing for do-it-yourself installation.
7. Wall-wart for power
8. Battery backup in case of power outage.

The emergency location identification has advantages: (1) an emergency location identification system activates in a quick, convenient and efficient manner; (2) the system is easy to install; (3) the device saves time for the emergency crew to find the emergency sites; (4) the device can be plugged into the cigarette lighter/computer outlet in the car for signaling help for roadside emergencies; (5) the device can be used as a lighting post for visitors; (6) the device is operated easily by the users even at a non-emergency situations; (7) the device can displays predetermined visual information for communication between the user (host) and the guests.

Although the present invention is briefly summarized, the full understanding of the invention can be obtained by the following drawings, detailed description, and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
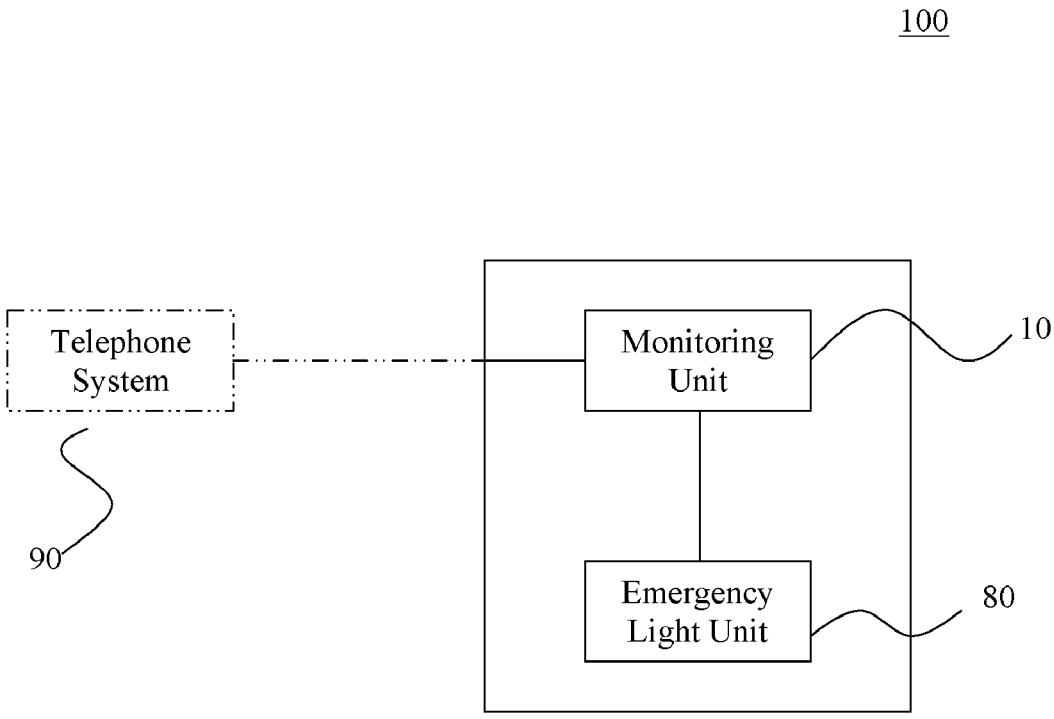
FIG. 1 is a block diagram illustrating an emergency location identification system connected to a telephone system according to the present invention.

FIG. 1 shows a schematic block diagram illustrating an emergency location identification system 100 connected to a telephone system 90 according to the present invention. The emergency location identification system 100 associated with a telephone system 90 comprises the monitoring unit 10 and the emergency light unit 80.

Figure 8:
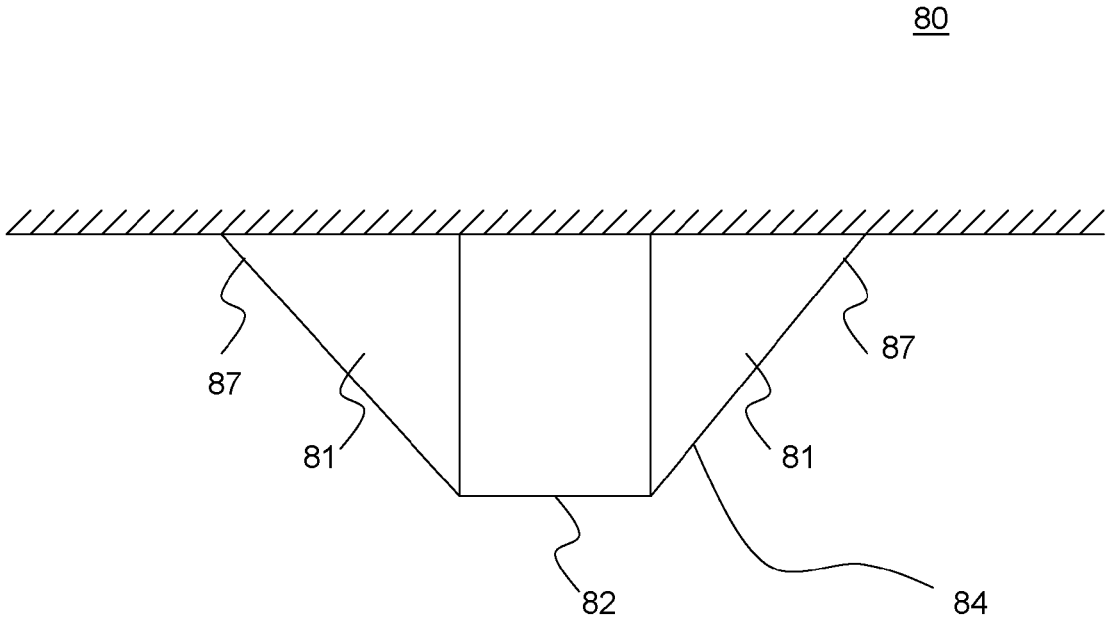
FIG. 8 is a top perspective view of an emergency light unit of FIG. 1.

The monitoring unit 10 is configured to be connected to the telephone system 90 for generating signals by monitoring phone calls made at the telephone system 90. The emergency light unit 80 is controlled by the signals from the monitoring unit 10. The emergency light unit 80 comprises one or more first light panels 81 and a plurality of second light panels 82 as shown in FIG. 8, and the light panels 81, 82 are disposed at a plurality of locations around a facility 92 in which the telephone system 90 is located as shown in FIG. 9.

Figure 9:
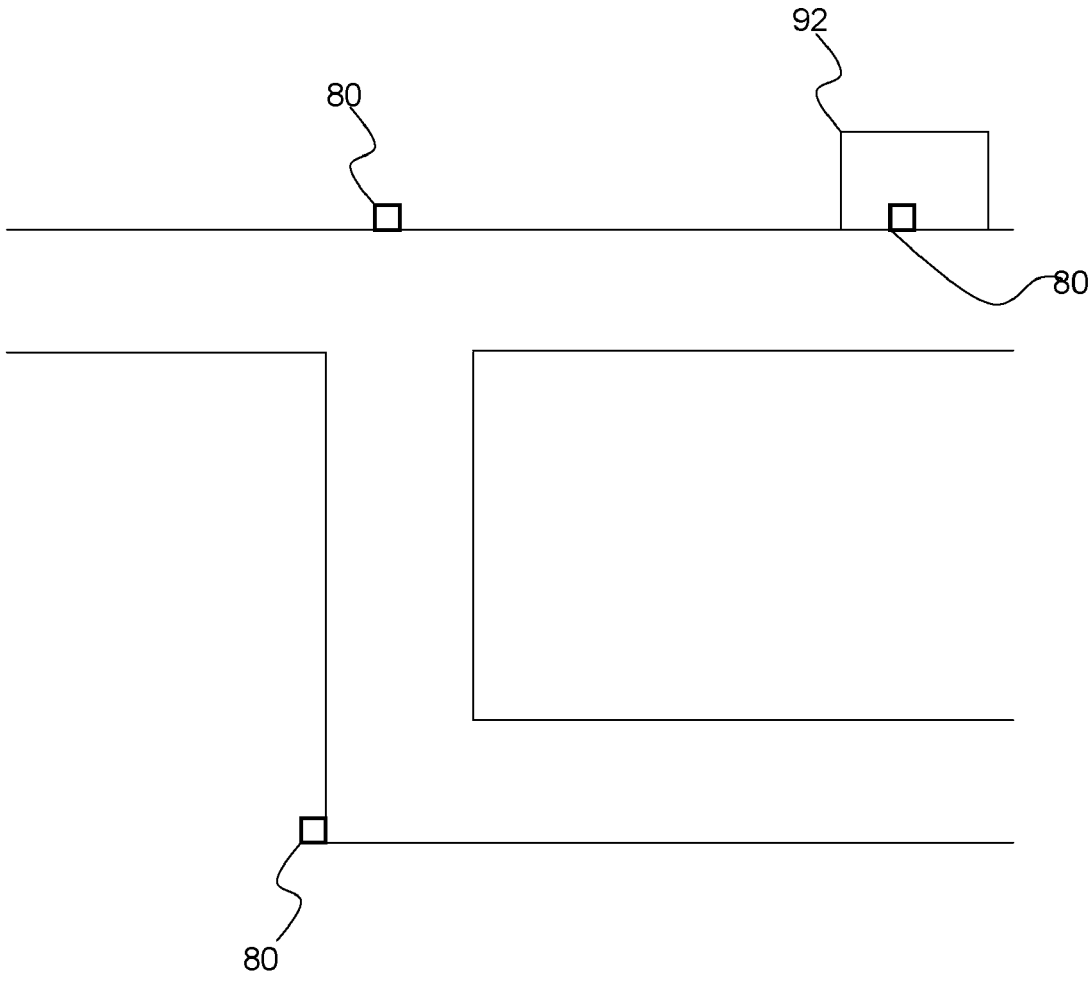
FIG. 9 is an embodiment of the emergency light unit.

The emergency light unit 80 is activated when an emergency call is made at the telephone system 90, and the emergency light unit 80 displays a visual identification and direction of the location 92 associated with the telephone system 90 as shown in FIGS. 1 and 9. The emergency call may comprise a 911 call. The telephone system 90 may comprise a plurality of phone jacks 91, and the monitoring unit 10 is adapted to be plugged into one of the phone jack 91 as shown in FIG. 2.

The telephone system 90 may comprise a main phone junction box (not shown), and the monitoring unit 10 is adapted to be connected to the main phone junction box. The monitoring unit 10 may comprise a power supplying module 70 as shown in FIG. 2, or may be configured to be plugged into an external power supply 79. The external power supply 79 comprises a wall outlet. The monitoring unit 10 may comprise a power backup (not shown). The power backup comprises one or more batteries. The monitoring unit 10 may be configured to be plugged into a cigarette lighter/computer plug in a vehicle such that the system 100 may be used when the user, the motorist, becomes lost/run off road/emergency on the road. They may be able to plug in the system 100 to signal an emergency just like at home.

The first light panel 81 may be lit steadily upon receiving a first signal from the monitoring unit 10, and the second light panel 82 flashes with a predetermined interval upon receiving a second signal from the monitoring unit 10. The second signal may be issued by the emergency call. The first light panel 81 may comprise a plurality of green lights. The second light panel 82 may comprise a plurality of flashing blue lights.

Figure 2:
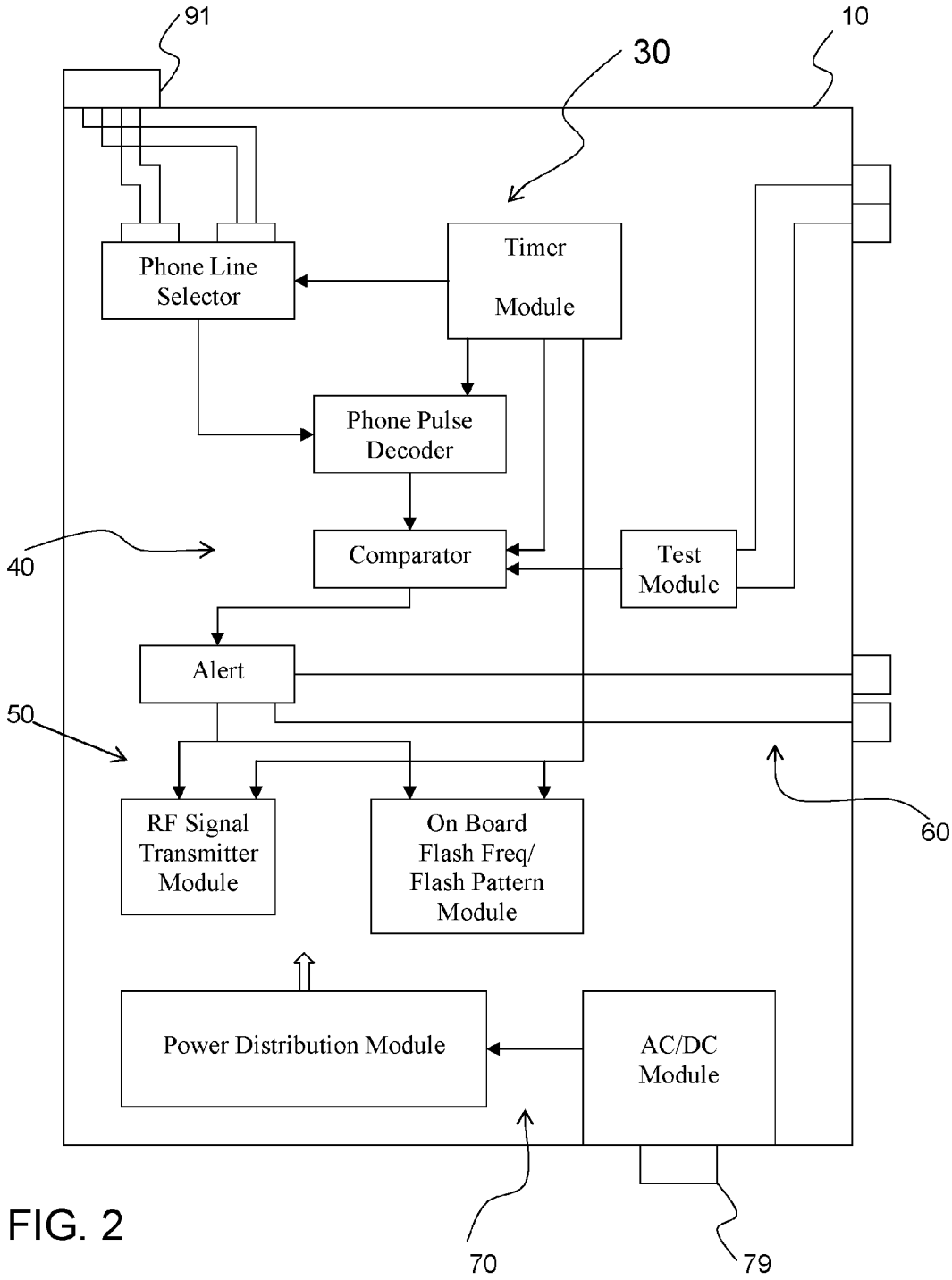
FIG. 2 is a block diagram illustrating a monitoring unit of the emergency location identification system of FIG. 1.
Figure 3:
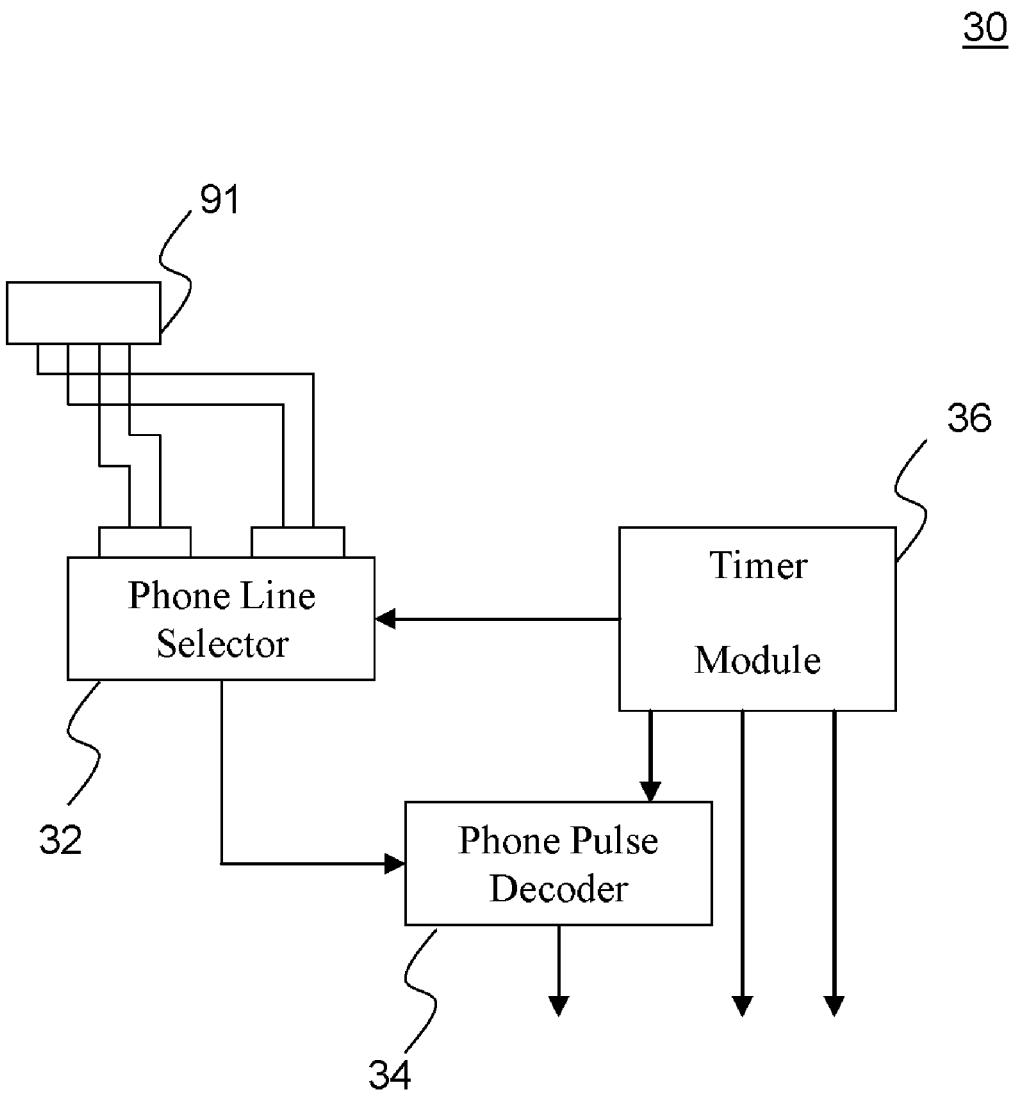
FIG. 3 is a block diagram illustrating a connection part of the system to a telephone system in FIG. 2.
Figure 6:
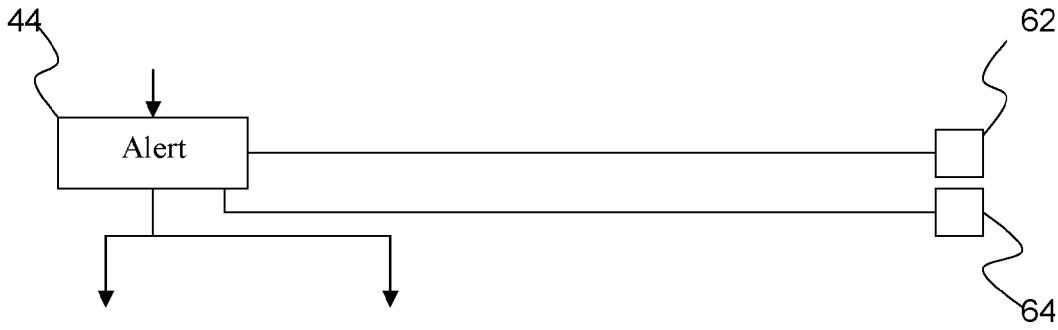
FIG. 6 is a block diagram illustrating a control part in FIG. 2.

The system 100 may further comprise a manual controller 60 for controlling the emergency location identification system 100 manually as shown in FIG. 2 and FIG. 6. The system 100 may further comprise a timer module 36 for controlling the time of operation of the light panels 81, 82, and the timer module 36 sets the time of operation of the light panels 81, 82 as shown in FIG. 2 and FIG. 3.

The system 100 may further comprise a flash sequencer 52 (FIG. 5) for controlling light flashing patterns of the second light panels 82. At least part of the first and second light panels 81, 82 are disposed around the facility 92 as shown in FIG. 9. The first and second light panels 81, 82 are disposed to indicate a direction to the facility 92.

The facility 92 may comprise a house, an apartment complex comprising a plurality of subdivisions that look alike, and a building comprising a plurality of rooms that look alike. At least part of the first and second light panels 81, 82 may be disposed at driveways or corners of neighboring buildings/streets. The first and second light panels 81, 82 may be disposed next to an address panel of the facility 92.

The emergency light unit 80 may further comprise one or more light casing 84. The light casing 84 contains at least part of the light panels 81, 82 as shown in FIG. 8. At least part of the light panels 81, 82 may have arrow shapes. The light panels 81, 82 having the arrow shape flash in a coordinated pattern simulating a flying arrow upon receiving a signal from the monitoring unit 10, and the signal is issued by the emergency call.

The monitoring unit 10 may be connected to the emergency light unit 80 by a plurality of wires. Alternatively, the monitoring unit 10 and the emergency light unit 80 may be connected wirelessly. As shown in FIG. 9, some of the emergency light unit 80 are installed well away from the facility 92, in which it is not convenient to connect the emergency light unit 80 to the monitoring unit 10 at the facility 92 by one or more wires. In such embodiments, the monitoring unit 10 may have a plurality of batteries (not shown) as a power supply. Then, the communication between the monitoring unit 10 and the emergency light unit 80 will be just control signals from the monitoring unit 10 to the emergency light unit 80. The RF signal transmitter module 54 in FIG. 5 sends the control signals to the emergency light unit 80. The emergency light unit 80 may comprise a receiver (not shown) for receiving the control signals from the monitoring unit 10.

FIG. 3 shows a block diagram illustrating a connection part 30 of the system 100 to a telephone system 90 in FIG. 2. The connection part 30 may comprise a phone line selector 32, a phone pulse decoder 34, and the timer module 36. The phone line selector 32 is for selecting a phone line to monitor out of many phone lines from the main phone junction box. The phone pulse decoder 34 decodes the phone pulse generated by the telephone system 90 to obtain a signal that a comparator 42 can use to determine if the phone call is, for example, a 911 call.

Figure 4:
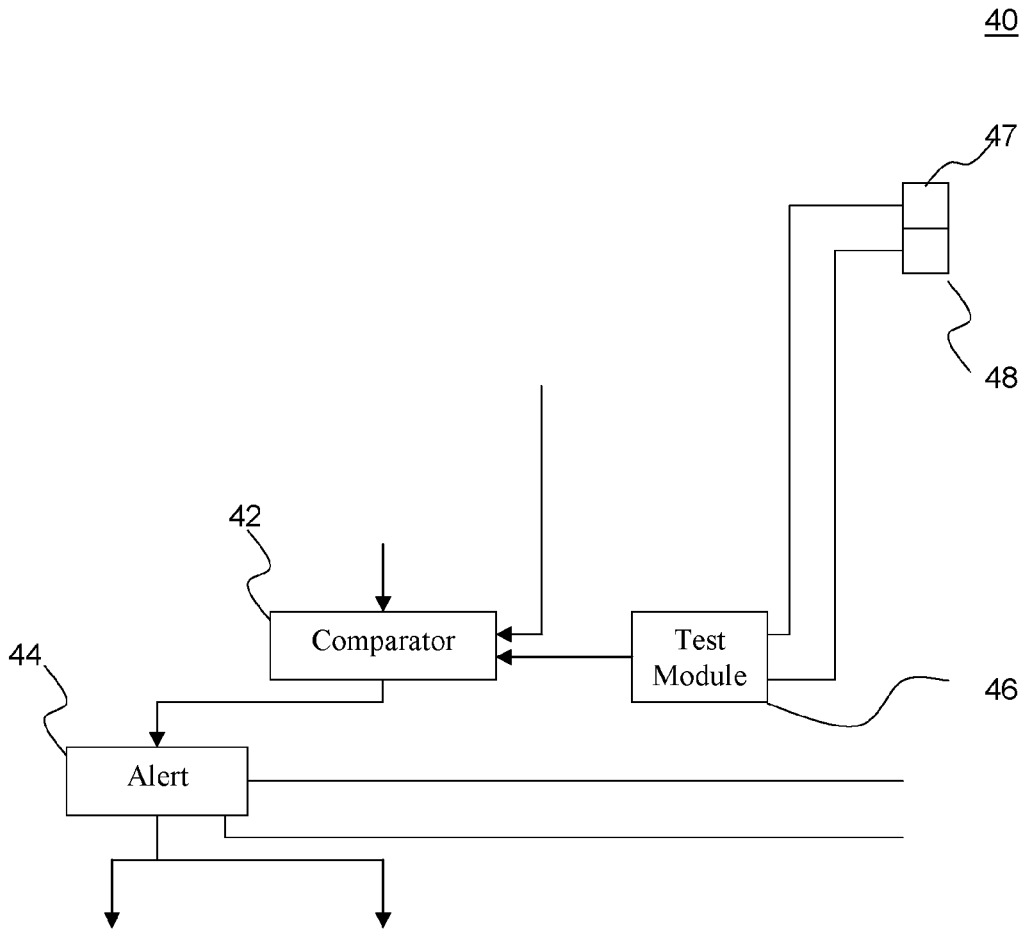
FIG. 4 is a block diagram illustrating a monitoring part in FIG. 2.

FIG. 4 shows a block diagram illustrating a monitoring part 40 in FIG. 2. The monitoring part 40 may comprise the comparator 42, an alert device 44, and a test module 46. The comparator 42 is for comparing the phone call with a plurality of predetermined phone calls, which comprises a 911 call. The alert device 44 issues the control signals for controlling the emergency light unit 80. The test module 46 is for testing the operation of the system 100. The test module 46 may comprise a reset switch 47 and a test switch 48 as shown in FIG. 2 and FIG. 4.

Figure 5:
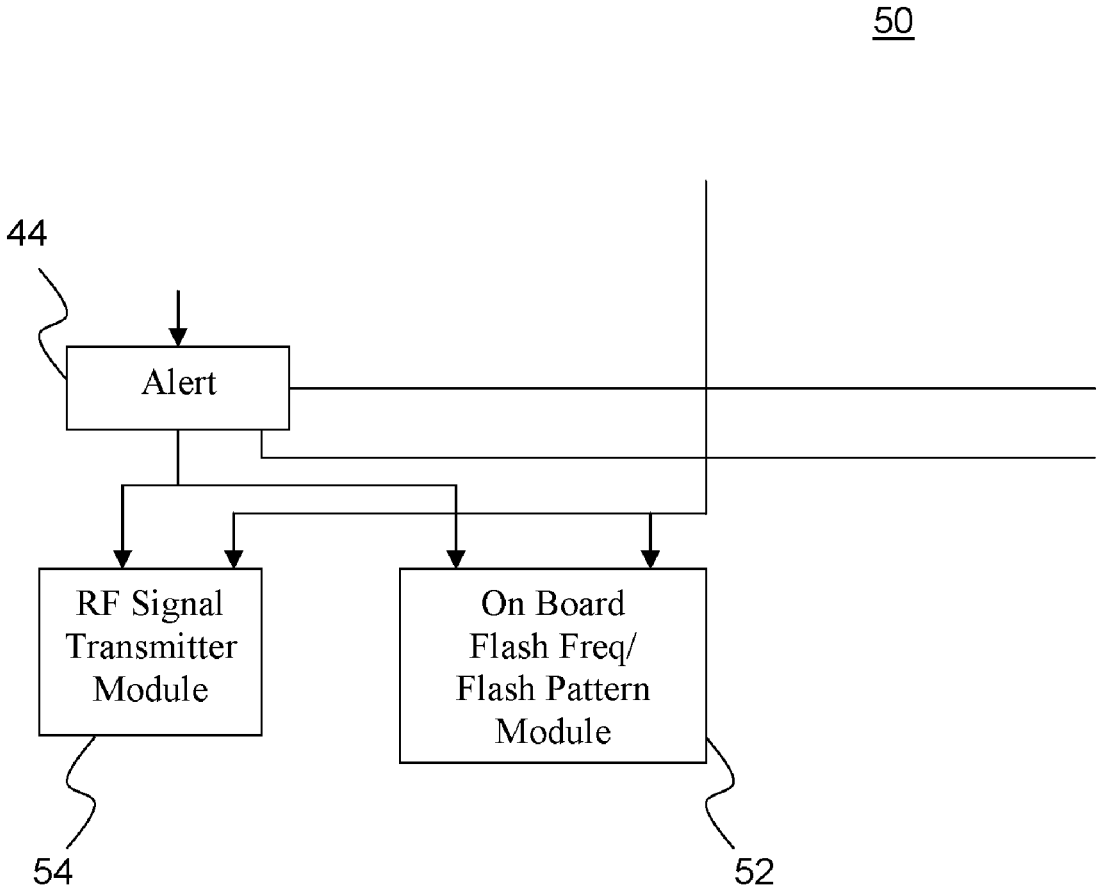
FIG. 5 is a block diagram illustrating a setting part in FIG. 2.

FIG. 5 shows a block diagram illustrating a setting part 50 in FIG. 2. The setting part 50 may comprise an on-board flash frequency and pattern module 52 and an RF signal transmitter module 54. The on-board flash frequency and pattern module 52 sets the frequency and pattern of the flashing light out of the second light panels 82.

FIG. 6 shows a block diagram illustrating a control part 60 in FIG. 2. The control part 60 may comprise an auxiliary input port 62 and an auxiliary output port 64. The control signals from the alert device 44 are sent out to the emergency light unit 80 through the auxiliary output port 64. The auxiliary input port 64 is used to control the behavior of the system 100 manually.

Figure 7:
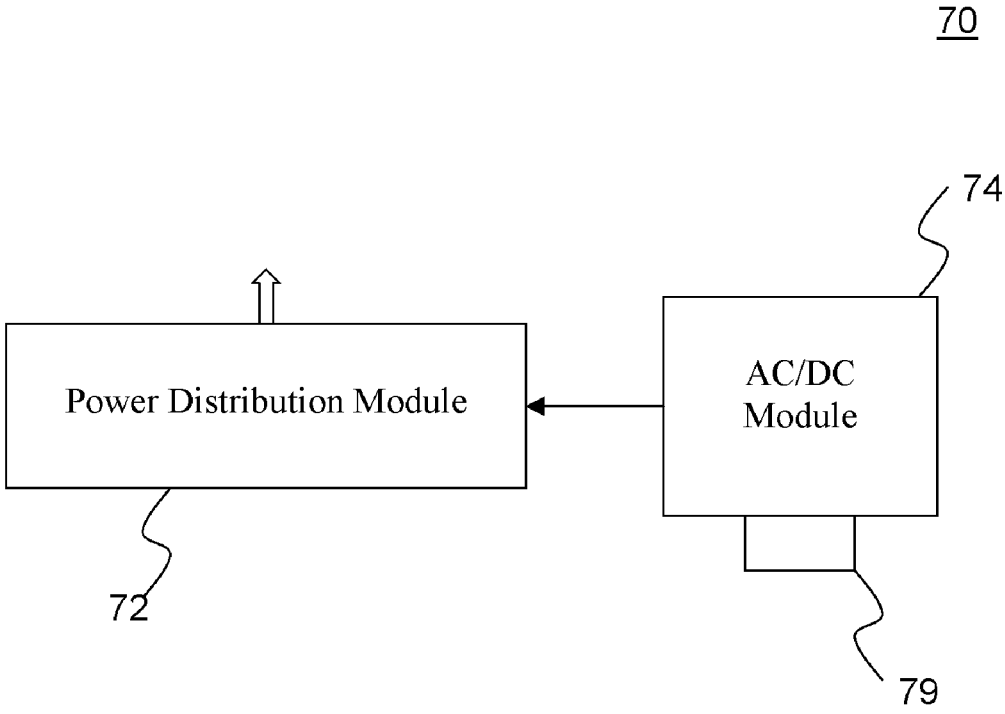
FIG. 7 is a block diagram illustrating a power supplying part in FIG. 2.

FIG. 7 is a block diagram illustrating a power supplying part 70 in FIG. 2. The power supplying part 70 may comprise a power distribution module 72 and an AC/DC module 74. The AC/DC module 74 rectifies the AC power from the wall outlet 79 into a DC power with a predetermined voltage. The power distribution module 72 distributes electric power to the parts of the system 100. When the emergency light unit 80 is connected to the monitoring unit 10 by wires, the emergency light unit 80 is powered by the power distribution module 72. When the emergency light unit 80 is connected to the monitoring unit 10 wirelessly, the emergency light unit 80 is powered by self-power source such as batteries. The monitoring unit 10 and the emergency light unit 80 may have back-up power such as batteries for the cases of power outages.

FIG. 8 is a top perspective view of an emergency light unit of FIG. 1. The emergency light unit may comprise first light panels 81, second light panels 82, and a light casing 84. The first light panel 81 may have a wedge shape so that the tilted side 87 is more visible from front and side. The light casing 84 may have a plurality of first and second light panels 81, 82. The light casing 84 is clear on top for visibility from the air.

FIG. 9 shows a plurality of the emergency light units 80 installed around the facility 92. The emergency light units 80 are disposed to lead the emergency crews to the facility 92. Some of the emergency light units 80 may contain arrow pattern on them to facilitate the visual directions.

The system 100 may portable. The monitoring unit 10 and the emergency light unit 80 are separable and each unit 10, 80 is portable. The units 10, 80 may communicate with each other wirelessly when separated. Each unit 10, 80 may include a self power backup such as batteries or solar cells. Therefore, the system 100 is easy to move around and install. The user may find good instances to use the system 100 in a vehicle.

While the invention has been shown and described with reference to different embodiments thereof, it will be appreciated by those skills in the art that variations in form, detail, compositions and operation may be made without departing from the spirit and scope of the invention as defined by the accompanying claims.

What is claimed is:

1. An emergency location identification system associated with a telephone system, comprising:

a monitoring unit configured to be connected to the telephone system for generating signals by monitoring phone calls made at the telephone system; and an emergency light unit controlled by the signals from the monitoring unit, the emergency light unit comprising one or more first light panels and a plurality of second light panels, wherein the light panels are disposed at a plurality of locations around a facility in which the telephone system is located, wherein the emergency light unit is activated when an emergency call is made at the telephone system, and wherein the emergency light unit displays a visual identification and direction of the location associated with the telephone system, wherein the first light panel is lit steadily upon receiving a first signal from the monitoring unit, wherein the second light panel flashes with a predetermined interval upon receiving a second signal from the monitoring unit, and wherein the second signal is issued by the emergency call.

2. The system of claim 1, wherein the emergency call comprises a 911 call.

3. The system of claim 1, wherein the telephone system comprises a plurality of phone jacks, and wherein the monitoring unit is adapted to be plugged into one of the phone jack.

4. The system of claim 1, wherein the telephone system comprises a main phone junction box, wherein the monitoring unit is adapted to be connected to the main phone junction box.

5. The system of claim 1, wherein the monitoring unit is configured to be plugged into an external power supply.

6. The system of claim 5, wherein the external power supply comprises a wall outlet.

7. The system of claim 5, wherein the monitoring unit comprises a power backup, and wherein the power backup comprises one or more batteries.

8. The system of claim 1, wherein the monitoring unit connected to the telephone system is configured to be plugged into a cigarette lighter/computer plug in a vehicle.

9. An emergency location identification system associated with a telephone system, comprising:

a monitoring unit configured to be connected to the telephone system for generating signals by monitoring phone calls made at the telephone system; and an emergency light unit controlled by the signals from the monitoring unit, the emergency light unit comprising one or more first light panels and a plurality of second light panels, wherein the light panels are disposed at a plurality of locations around a facility in which the telephone system is located, wherein the emergency light unit is activated when an emergency call is made at the telephone system, and wherein the emergency light unit displays a visual identification and direction of the location associated with the telephone system, wherein the first light panel is lit steadily upon receiving a first signal from the monitoring unit, wherein the second light panel flashes with a predetermined interval upon receiving a second signal from the monitoring unit, and wherein the second signal is issued by the emergency call, wherein the first light panel comprises a plurality of green lights, wherein the second light panel comprises a plurality of flashing blue lights.

10. The system of claim 1, further comprising a manual controller for controlling the emergency location identification system manually.

11. The system of claim 10, further comprising a timer for controlling the time of operation of the light panels, wherein the timer sets the time of operation of the light panels.

12. The system of claim 1, further comprising a flash sequencer for controlling light flashing patterns of the second light panels.

13. The system of claim 1, wherein at least part of the first and second light panels are disposed around the facility.

14. The system of claim 13, wherein at least part of the first and second light panels are disposed to indicate a direction to the facility.

15. The system of claim 14, wherein the facility comprises a house, an apartment complex comprising a plurality of subdivisions which look alike, and a building comprising a plurality of rooms which look alike.

16. The system of claim 14, wherein at least part of the first and second light panels are disposed at driveways or corners of neighboring streets.

17. The system of claim 14, wherein at least part of the first and second light panels are disposed next to an address panel of the facility.

18. The system of claim 1, wherein the emergency light unit further comprises one or more light casing, wherein the light casing contains at least part of the lights.

19. An emergency location identification system associated with a telephone system, comprising:

a monitoring unit configured to be connected to the telephone system for generating signals by monitoring phone calls made at the telephone system; and an emergency light unit controlled by the signals from the monitoring unit, the emergency light unit comprising one or more first light panels and a plurality of second light panels, wherein the light panels are disposed at a plurality of locations around a facility in which the telephone system is located, wherein the emergency light unit is activated when an emergency call is made at the telephone system, and wherein the emergency light unit displays a visual identification and direction of the location associated with the telephone system, wherein at least part of the light panels have arrow shapes, wherein the light panels having the arrow shape flash in a coordinated pattern simulating a flying arrow upon receiving a signal from the monitoring unit, and wherein the signal is issued by the emergency call.

* * * * *